United States Patent [19]

Buss et al.

[11] 4,456,527

[45] Jun. 26, 1984

[54] HYDROCARBON CONVERSION PROCESS

[75] Inventors: Waldeen C. Buss, Kensington; Leslie A. Field, Oakland; Richard C. Robinson, San Rafael, all of Calif.

[73] Assignee: Chevron Research Company, San Francisco, Calif.

[21] Appl. No.: 477,111

[22] Filed: Mar. 21, 1983

Related U.S. Application Data

[63] Continuation-in-part of Ser. No. 436,498, Oct. 20, 1982, abandoned.

[51] Int. Cl.[3] ..... C10G 45/00

[52] U.S. Cl. ..... 208/89; 208/138

[58] Field of Search ..... 208/89, 138

[56] References Cited

U.S. PATENT DOCUMENTS 3,783,123 1/1974 Young ..... 208/111

3,884,797 5/1975 Alley et al. ..... 208/89

*Primary Examiner*—Curtis R. Davis

*Attorney, Agent, or Firm*—S. R. LaPaglia; W. K. Turner; E. A. Schaal

[57] ABSTRACT

A hydrocarbon conversion process is disclosed having a very high selectivity for dehydrocyclization. In one aspect of this process, a hydrocarbon feed is subjected to hydrotreating, then the hydrocarbon feed is passed through a sulfur removal system which reduces the sulfur concentration of the hydrocarbon feed to below 500 ppb, and then the hydrocarbon feed is reformed over a dehydrocyclization catalyst comprising a large pore zeolite containing at least one Group VIII metal to produce aromatics and hydrogen.

14 Claims, No Drawings

HYDROCARBON CONVERSION PROCESS

CROSS-REFERENCE TO RELATED APPLICATION

This is a continuation-in-part of application Ser. No. 436,498, filed Oct. 20, 1982 and now abandoned.

BACKGROUND OF THE INVENTION

The present invention relates to an improved reforming process having a superior selectivity for dehydrocyclization.

Catalytic reforming is well known in the petroleum industry and refers to the treatment of naphtha fractions to improve the octane rating by the production of aromatics. The more important hydrocarbon reactions occurring during reforming operation include dehydrogenation of cyclohexanes to aromatics, dehydroisomerization of alkylcyclopentanes to aromatics, and dehydrocyclization of acyclic hydrocarbons to aromatics. A number of other reactions also occur, including the following: dealkylation of alkylbenzenes, isomerization of paraffins, and hydrocracking reactions which produce light gaseous hydrocarbons, e.g., methane, ethane, propane and butane. Hydrocracking reactions are to be particularly minimized during reforming as they decrease the yield of gasoline boiling products.

Because of the demand for high octane gasoline for use as motor fuels, etc., extensive research is being devoted to the development of improved reforming catalysts and catalytic reforming processes. Catalysts for successful reforming processes must possess good selectivity, i.e., be able to produce high yields of liquid products in the gasoline boiling range containing large concentrations of high octane number aromatic hydrocarbons and accordingly, low yields of light gaseous hydrocarbons. The catalysts should possess good activity in order that the temperature required to produce a certain quality product need not be too high. It is also necessary that catalysts possess good stability in order that the activity and selectivity characteristics can be retained during prolonged periods of operation.

Catalysts comprising platinum, for example, platinum supported on alumina, are well known and widely used for reforming of naphthas. The most important products of catalytic reforming are benzene and alkylbenzenes. These aromatic hydrocarbons are of great value as high octane number components of gasoline.

Catalytic reforming is also an important process for the chemical industry because of the great and expanding demand for aromatic hydrocarbons for use in the manufacture of various chemical products such as synthetic fibers, insecticides, adhesives, detergents, plastics, synthetic rubbers, pharmaceutical products, high octane gasoline, perfumes, drying oils, ion-exchange resins, and various other products well known to those skilled in the art. One example of this demand is in the manufacture of alkylated aromatics such as ethylbenzene, cumene and dodecylbenzene by using the appropriate mono-olefins to alkylate benzene. Another example of this demand is in the area of chlorination of benzene to give chlorobenzene which is then used to prepare phenol by hydrolysis with sodium hydroxide. The chief use for phenol is in the manufacture of phenol-formaldehyde resins and plastics. Another route to phenol uses cumene as a starting material and involves the oxidation of cumene by air to cumene hydroperoxide which can then be decomposed to phenol and acetone by the action of an appropriate acid. The demand for ethylbenzene is primarily derived from its use to manufacture styrene by selective dehydrogenation; styrene is in turn used to make styrene-butadiene rubber and polystyrene. Ortho-xylene is typically oxidized to phthalic anhydride by reaction in vapor phase with air in the presence of a vanadium pentoxide catalyst. Phthalic anhydride is in turn used for production of plasticizers, polyesters and resins. The demand for para-xylene is caused primarily by its use in the manufacture of terephthalic acid or dimethylterephthalate which in turn is reacted with ethylene glycol and polymerized to yield polyester fibers. Substantial demand for benzene also is associated with its use to produce aniline, nylon, maleic anhydride, solvents and the like petrochemical products. Toluene, on the other hand, is not, at least relative to benzene and the $C_8$ aromatics, in great demand in the petrochemical industry as a basic building block chemical; consequently, substantial quantities of toluene are hydrodealkylated to benzene or disproportionated to benzene and xylene. Another use for toluene is associated with the transalkylation of trimethylbenzene with toluene to yield xylene.

Responsive to this demand for these aromatic products, the art has developed and industry has utilized a number of alternative methods to produce them in commercial quantities. One response has been the construction of a significant number of catalytic reformers dedicated to the production of aromatic hydrocarbons for use as feedstocks for the production of chemicals. As is the case with most catalytic processes, the principal measure of effectiveness for catalytic reforming involves the ability of the process to convert the feedstocks to the desired products over extended periods of time with minimum interference of side reactions.

The dehydrogenation of cyclohexane and alkylcyclohexanes to benzene and alkylbenzenes is the most thermodynamically favorable type of aromatization reaction of catalytic reforming. This means that dehydrogenation of cyclohexanes can yield a higher ratio of (aromatic product/nonaromatic reactant) than either of the other two types of aromatization reactions at a given reaction temperature and pressure. Moreover, the dehydrogenation of cyclohexanes is the fastest of the three aromatization reactions. As a consequence of these thermodynamic and kinetic considerations, the selectivity for the dehydrogenation of cyclohexanes is higher than that for dehydroisomerization or dehydrocyclization. Dehydroisomerization of alkylcyclopentanes is somewhat less favored, both thermodynamically kinetically. Its selectivity, although generally high, is lower than that for dehydrogenation. Dehydrocyclization of paraffins is much less favored both thermodynamically and kinetically. In conventional reforming, its selectivity is much lower than that for the other two aromatization reactions.

The selectivity disadvantage of paraffin dehydrocyclization is particularly large for the aromatization of compounds having a small number of carbon atoms per molecule. Dehydrocyclization selectivity in conventional reforming is very low for $C_6$ hydrocarbons. It increases with the number of carbon atoms per molecule, but remains substantially lower than the aromatization selectivity for dehydrogenation or dehydroisomerization of naphthenes having the same number of carbon atoms per molecule. A major improvement in the catalytic reforming process will require, above all else, a drastic improvement in dehydrocyclization selectivity that can be achieved while maintaining adequate catalyst activity and stability.

In the dehydrocyclization reaction, acyclic hydrocarbons are both cyclized and dehydrogenated to produce aromatics. The conventional methods of performing these dehydrocyclization reactions are based on the use of catalysts comprising a noble metal on a carrier. Known catalysts of this kind are based on alumina carrying 0.2% to 0.8% by weight of platinum and preferably a second auxiliary metal.

A disadvantage of conventional naphtha reforming catalysts is that with $C_6$–$C_8$ paraffins, they are usually more selective for other reactions (such as hydrocracking) than they are for dehydrocyclization. A major advantage of the catalyst used in the present invention is its high selectivity for dehydrocyclization.

The possibility of using carriers other than alumina has also been studied and it was proposed to use certain molecular sieves such as X and Y zeolites, which have pores large enough for hydrocarbons in the gasoline boiling range to pass through. However, catalysts based upon these molecular sieves have not been commercially successful.

In the conventional method of carrying out the aforementioned dehydrocyclization, acyclic hydrocarbons to be converted are passed over the catalyst, in the presence of hydrogen, at temperatures of the order of 500° C. and pressures of from 5 to 30 bars. Part of the hydrocarbons are converted into aromatic hydrocarbons, and the reaction is accompanied by isomerization and cracking reactions which also convert the paraffins into isoparaffins and lighter hydrocarbons.

The rate of conversion of the acyclic hydrocarbons into aromatic hydrocarbons varies with the number of carbon atoms per reactant molecule, reaction conditions and the nature of the catalyst.

The catalysts hitherto used have given satisfactory results with heavy paraffins, but less satisfactory results with $C_6$–$C_8$ paraffins, particularly $C_6$ paraffins. Catalysts based on a type L zeolite are more selective with regard to the dehydrocyclization reaction; can be used to improve the rate of conversion to aromatic hydrocarbons without requiring higher temperatures than those dictated by thermodynamic considerations (higher temperatures usually have a considerable adverse effect on the stability of the catalyst); and produce excellent results with $C_6$–$C_8$ paraffins, but catalysts based on type L zeolite have not achieved commercial usage because of inadequate stability. The prior art has not been successful in producing a type L zeolite catalyst having sufficient life to be practical in commercial operation.

In one method of dehydrocyclizing aliphatic hydrocarbons, hydrocarbons are contacted in the presence of hydrogen with a catalyst consisting essentially of a type L zeolite having exchangeable cations of which at least 90% are alkali metal ions selected from the group consisting of ions of lithium, sodium, potassium, rubidium and cesium and containing at least one metal selected from the group which consists of metals of Group VIII of the Periodic Table of Elements, tin and germanium, said metal or metals including at least one metal from Group VIII of said Periodic Table having a dehydrogenating effect, so as to convert at least part of the feedstock into aromatic hydrocarbons.

A particularly advantageous embodiment of this method is a platinum/alkali metal/type L zeolite catalyst containing cesium or rubidium because of its excellent activity and selectivity for converting hexanes and heptanes to aromatics, but stability remains a problem.

SUMMARY OF THE INVENTION

The present invention overcomes the stability problems of the prior art by recognizing the surprisingly high sensitivity of large-pore zeolite reforming catalysts to sulfur and controlling the sulfur concentration of the hydrocarbon feed to less than 500 ppb, preferably less than 100 ppb, which enables the catalyst run life to be extended such that the process is commercially viable. Operation in this manner enables run lengths in excess of six months to be achieved. Surprisingly, the sulfur levels required are an order of magnitude lower than permissible for even the most sulfur-sensitive conventional bimetallic reforming catalysts.

DESCRIPTION OF THE PREFERRED EMBODIMENTS

In the broadest aspect the present invention consists of reforming a hydrocarbon feedstock of exceedingly low sulfur content (less than 500 ppb) over a large pore zeolite (preferably a type L zeolite), but preferably less than 250 ppb, and more preferably less than 100 ppb and most preferably less than 50 ppb.

In another aspect, the present invention involves the hydrotreating of a hydrocarbon feed which is subsequently passed through a sulfur removal system to reduce the sulfur concentration of the feed to below 500 ppb and reforming that feed over a dehydrocyclization catalyst comprising a type L zeolite and a Group VIII metal. This dehydrocyclization is preferably carried out using a dehydrocyclization catalyst comprising a type L zeolite, an alkaline earth metal, and a Group VIII metal.

The term "selectivity" as used in the present invention is defined as the percentage of moles of acyclic hydrocarbons converted to aromatics relative to moles converted to aromatics and cracked products, $$\text{i.e., Selectivity} = \frac{100 \times \text{moles of acyclic hydrocarbons converted to aromatics}}{\text{moles of acyclic hydrocarbons converted to aromatics and cracked products}}$$

Isomerization of paraffins and interconversion of paraffins and alkylcyclopentanes having the same number of carbon atoms per molecule are not considered in determining selectivity.

The selectivity for converting acyclic hydrocarbons to aromatics is a measure of the efficiency of the process in converting acyclic hydrocarbons to the desired and valuable products: aromatics and hydrogen, as opposed to the less desirable products of hydrocracking.

Highly selective catalysts produce more hydrogen than less selective catalysts because hydrogen is produced when acyclic hydrocarbons are converted to aromatics and hydrogen is consumed when acyclic hydrocarbons are converted to cracked products. Increasing the selectivity of the process increases the amount of hydrogen produced (more aromatization) and decreases the amount of hydrogen consumed (less cracking).

Another advantage of using highly selective catalysts is that the hydrogen produced by highly selective catalysts is purer than that produced by less selective catalysts. This higher purity results because more hydrogen is produced, while less low boiling hydrocarbons (cracked products) are produced. The purity of hydrogen produced in reforming is critical if, as is usually the case in an integrated refinery, the hydrogen produced is utilized in processes such as hydrotreating and hydrocracking, which require at least certain minimum partial pressures of hydrogen. If the purity becomes too low, the hydrogen can no longer be used for this purpose and must be used in a less valuable way, for example as fuel gas.

Feedstock

Regarding the acyclic hydrocarbons that are subjected to the method of the present invention, they are most commonly paraffins but can in general be any acyclic hydrocarbon capable of undergoing ring-closure to produce an aromatic hydrocarbon. That is, it is intended to include within the scope of the present invention, the dehydrocyclization of any acyclic hydrocarbon capable of undergoing ring-closure to produce an aromatic hydrocarbon and capable of being vaporized at the dehydrocyclization temperatures used herein. More particularly, suitable acyclic hydrocarbons include acyclic hydrocarbons containing 6 or more carbon atoms per molecule such as $C_6$–$C_{20}$ paraffins, and $C_6$–$C_{20}$ olefins. Specific examples of suitable acyclic hydrocarbons are: (1) paraffins such as n-hexane, 2-methylpentane, 3-methylpentane, n-heptane, 2-methylhexane, 3-methylhexane, 3-ethylpentane, 2,5-dimethylhexane, n-octane, 2-methylheptane, 3-methylheptane, 4-methylheptane, 3-ethylhexane, n-nonane, 2-methyloctane, 3-methyloctane, n-decane and the like compounds; and (2) olefins such as 1-hexene, 2-methyl-1-pentene, 1-heptene, 1-octene, 1-nonene and the like compounds.

In a preferred embodiment, the acyclic hydrocarbon is a paraffinic hydrocarbon having about 6 to 10 carbon atoms per molecule. It is to be understood that the specific acyclic hydrocarbons mentioned above can be charged to the present method individually, in admixture with one or more of the other acyclic hydrocarbons, or in admixture with other hydrocarbons such as naphthenes, aromatics and the like. Thus mixed hydrocarbon fractions, containing significant quantities of acyclic hydrocarbons that are commonly available in a typical refinery, are suitable charge stocks for the instant method; for example, highly paraffinic straight-run naphthas, paraffinic raffinates from aromatic extraction or adsorption, $C_6$–$C_9$ paraffin-rich streams and the like refinery streams. An especially preferred embodiment involves a charge stock which is a paraffin-rich naphtha fraction boiling in the range of about 140° F. to about 350° F. Generally, best results are obtained with a charge stock comprising a mixture of $C_6$–$C_{10}$ paraffins, especially $C_6$–$C_8$ paraffins.

Dehydrocyclization Reaction

According to the present invention, the hydrocarbon feedstock containing less than 500 ppb (preferably less than 100 ppb, more preferably less than 50 ppb) sulfur is contacted with the catalyst in a dehydrocyclization zone maintained at dehydrocyclization conditions. This contacting may be accomplished by using the catalyst in a fixed bed system, a moving bed system, a fluidized system, or in a batch-type operation. It is also contemplated that the contacting step can be performed in the presence of a physical mixture of particles of a conventional dual-function catalyst of the prior art. In a fixed bed system, the hydrocarbons in the $C_6$ to $C_{11}$ range are preheated by any suitable heating means to the desired reaction temperature and then passed into a dehydrocyclization zone containing a fixed bed of the catalyst. It is, of course, understood that the dehydrocyclization zone may be one or more separate reactors with suitable means therebetween to ensure that the desired conversion temperature is maintained at the entrance to each reactor. It is also important to note that the reactants may be contacted with the catalyst bed in either upward, downward, or radial flow fashion. In addition, the reactants may be in a liquid phase, a mixed liquid-vapor phase, or a vapor phase when they contact the catalyst, with best results obtained in the vapor phase. The dehydrocyclization system then preferably comprises a dehydrocyclization zone containing one or more fixed beds or dense-phase moving beds of the catalyst. In a multiple bed system, it is, of course, within the scope of the present invention to use the present catalyst in less than all of the beds with a conventional dual-function catalyst being used in the remainder of the beds. The dehydrocyclization zone may be one or more separate reactors with suitable heating means therebetween to compensate for the endothermic nature of the dehydrocyclization reaction that takes place in each catalyst bed.

Although hydrogen is the preferred diluent for use in the subject dehydrocyclization method, in some cases other art-recognized diluents may be advantageously utilized, either individually or in admixture with hydrogen, such as $C_1$ to $C_5$ paraffins such as methane, ethane, propane, butane and pentane; the like diluents, and mixtures thereof. Hydrogen is preferred because it serves the dual function of not only lowering the partial pressure of the acyclic hydrocarbon, but also of suppressing the formation of hydrogen-deficient, carbonaceous deposits (commonly called coke) on the catalytic composite. Ordinarily, hydrogen is utilized in amounts sufficient to insure a hydrogen to hydrocarbon mole ratio of about 0 to about 20:1, with best results obtained in the range of about 2:1 to about 6:1. The hydrogen charged to the dehydrocyclization zone will typically be contained in a hydrogen-rich gas stream recycled from the effluent stream from this zone after a suitable gas/liquid separation step.

The hydrocarbon dehydrocyclization conditions used in the present method include a reactor pressure which is selected from the range of about 1 atmosphere to about 500 psig, with the preferred pressure being about 50 psig to about 200 psig. The temperature of the dehydrocyclization is preferably about 450° C. to about 550° C. As is well known to those skilled in the dehydrocyclization art, the initial selection of the temperature within this broad range is made primarily as a function of the desired conversion level of the acyclic hydrocarbon considering the characteristics of the charge stock and of the catalyst. Ordinarily, the temperature then is thereafter slowly increased during the run to compensate for the inevitable deactivation that occurs to provide a relatively constant value for conversion.

The liquid hourly space velocity (LHSV) used in the instant dehydrocyclization method is selected from the range of about 0.1 to about 10 $hr.^{-1}$, with a value in the range of about 0.3 to about 5 $hr.^{-1}$ being preferred.

Reforming generally results in the production of hydrogen. Thus, exogenous hydrogen need not necessarily be added to the reforming system except for prereduction of the catalyst and when the feed is first introduced. Generally, once reforming is underway, part of the hydrogen produced is recirculated over the catalyst. The presence of hydrogen serves to reduce the formation of coke which tends to deactivate the catalyst. Hydrogen is preferably introduced into the reforming reactor at a rate varying from 0 to about 20 moles of hydrogen per mole of feed. The hydrogen can be in admixture with light gaseous hydrocarbons.

If, after a peridod of operation, the catalyst has become deactivated by the presence of carbonaceous deposits, said deposits can be removed from the catalyst by passing an oxygen-containing gas, such as dilute air, into contact with the catalyst at an elevated temperature in order to burn the carbonaceous deposits from the catalyst. The method of regenerating the catalyst will depend on whether there is a fixed bed, moving bed, or fluidized bed operation. Regeneration methods and conditions are well known in the art.

The Dehydrocyclization Catalyst

The dehydrocyclization catalyst according to the invention is a large-pore zeolite charged with one or more dehydrogenating constituents. The term "large-pore zeolite" is defined as a zeolite having an effective pore diameter of 6 to 15 Angstroms.

Among the large-pored crystalline zeolites which have been found to be useful in the practice of the present invention, type L zeolite, zeolite X, zeolite Y and faujasite are the most important and have apparent pore sizes on the order of 7 to 9 Angstroms.

The chemical formula for zeolite Y expressed in terms of mole oxides may be written as:

$$(0.7\text{-}1.1)Na_2O:Al_2O_3:xSiO_2:yH_2O$$

wherein x is a value greater than 3 up to about 6 and y may be a value up to about 9. Zeolite Y has a characteristic X-ray powder diffraction pattern which may be employed with the above formula for identification. Zeolite Y is described in more detail in U.S. Pat. No. 3,130,007. U.S. Pat. No. 3,130,007 is hereby incorporated by reference to show a zeolite useful in the present invention.

Zeolite X is a synthetic crystalline zeolitic molecular sieve which may be represented by the formula:

$$(0.7\text{-}1.1)M_{2/n}O:Al_2O_3:(2.0\text{-}3.0)SiO_2:yH_2O$$

wherein M represents a metal, particularly alkali and alkaline earth metals, n is the valence of M, and y may have any value up to about 8 depending on the identity of M and the degree of hydration of the crystalline zeolite. Zeolite X, its X-ray diffraction pattern, its properties, and method for its preparation are described in detail in U.S. Pat. No. 2,882,244. U.S. Pat. No. 2,882,244 is hereby incorporated by reference to show a zeolite useful in the present invention.

The preferred catalyst according to the invention is a type L zeolite charged with one or more dehydrogenating constituents.

Type L zeolites are synthetic zeolites. A theoretical formula is $M_{9/n}[(AlO_2)_9(SiO_2)_{27}]$ in which M is a cation having the valency n.

The real formula may vary without changing the crystalline structure; for example, the mole ratio of silicon to aluminum (Si/Al) may vary from 1.0 to 3.5.

Although there are a number of cations that may be present in zeolite L, in one embodiment, it is preferred to synthesize the potassium form of the zeolite, i.e., the form in which the exchangeable cations present are substantially all potassium ions. The reactants accordingly employed are readily available and generally water soluble. The exchangeable cations present in the zeolite may then conveniently be replaced by other exchangeable cations, as will be shown below, thereby yielding isomorphic form of zeolite L.

In one method of making zeolite L, the potassium form of zeolite L is prepared by suitably heating an aqueous metal aluminosilicate mixture whose composition, expressed in terms of the mole ratios of oxides, falls within the range:

| | |
|---|---|
| $K_2O/(K_2O + Na_2O)$ | From about 0.33 to about 1 |
| $(K_2O + Na_2O)/SiO_2$ | From about 0.35 to about 0.5 |
| $SiO_2/Al_2O_3$ | From about 10 to about 28 |
| $H_2O/(K_2O + Na_2O)$ | From about 15 to about 41 |

The desired product is hereby crystallized out relatively free from zeolites of dissimilar crystal structure.

The potassium form of zeolite L may also be prepared in another method along with other zeolitic compounds by employing a reaction mixture whose composition, expressed in terms of mole ratios of oxides, falls within the following range:

| | |
|---|---|
| $K_2O/(K_2O + Na_2O)$ | From about 0.26 to about 1 |
| $(K_2O + Na_2O)/SiO_2$ | From about 0.34 to about 0.5 |
| $SiO_2/Al_2O_3$ | From about 15 to about 28 |
| $H_2O/(K_2O + Na_2O)$ | From about 15 to about 51 |

It is to be noted that the presence of sodium in the reaction mixture is not critical to the present invention.

When the zeolite is prepared from reaction mixtures containing sodium, sodium ions are generally also included within the product as part of the exchangeable cations together with the potassium ions. The product obtained from the above ranges has a composition, expressed in terms of moles of oxides, corresponding to the formula:

$$0.9\text{-}1.3[(1-x)K_2O, xNa_2O]:Al_2O_3:5.2\text{-}6.9SiO_2:yH_2O$$

wherein "x" may be any value from 0 to about 0.75 and "y" may be any value from 0 to about 9.

In making zeolite L, representative reactants are activated alumina, gamma alumina, alumina trihydrate and sodium aluminate as a source of alumina. Silica may be obtained from sodium or potassium silicate, silica gels, silicic acid, aqueous colloidal silica sols and reactive amorphous solid silicas. The preparation of typical silica sols which are suitable for use in the process of the present invention are described in U.S. Pat. No. 2,574,902 and U.S. Pat. No. 2,597,872. Typical of the group of reactive amorphous solid silicas, preferably having an ultimate size of less than 1 micron, are such materials as fume silicas, chemically precipitated and precipitated silica sols. Potassium and sodium hydroxide may supply the metal cation and assist in controlling pH.

In making zeolite L, the usual method comprises dissolving potassium or sodium aluminate and alkali, viz., potassium or sodium hydroxide, in water. This solution is admixed with a water solution of sodium silicate, or preferably with a water-silicate mixture derived at least in part from an aqueous colloidal silica sol. The resultant reaction mixture is placed in a container made, for example, of metal or glass. The container should be closed to prevent loss of water. The reaction mixture is then stirred to insure homogeneity.

The zeolite may be satisfactorily prepared at temperatures of from about 90° C. to 200° C. the pressure being atmospheric or at least that corresponding to the vapor pressure of water in equilibrium with the mixture of reactants at the higher temperature. Any suitable heating apparatus, e.g., an oven, sand bath, oil bath or jacketed autoclave, may be used. Heating is continued until the desired crystalline zeolite product is formed. The zeolite crystals are then filtered off and washed to separate them from the reactant mother liquor. The zeolite crystals should be washed, preferably with distillated water, until the effluent wash water, in equilibrium with the product, has a pH of between about 9 and 12. As the zeolite crystals are washed, the exchangeable cation of the zeolite may be partially removed and is believed to be replaced by hydrogen cations. If the washing is discontinued when the pH of the effluent wash water is between about 10 and 11, the $(K_2O+Na_2O)/Al_2O_3$ molar ratio of the crystalline product will be approximately 1.0. Thereafter, the zeolite crystals may be dried, conveniently in a vented oven.

Zeolite L has been characterized in "Zeolite Molecular Sieves" by Donald W. Breck, John Wiley & Sons, 1974, as having a framework comprising 18 tetrahedra unit cancrinite-type cages linked by double 6-rings in columns and crosslinked by single oxygen bridges to form planar 12-membered rings. These 12-membered rings produce wide channels parallel to the c-axis with no stacking faults. Unlike erionite and cancrinite, the cancrinite cages are symmetrically placed across the double 6-ring units. There are four types of cation locations: A in the double 6-rings, B in the cancrinite-type cages, C between the cancrinite-type cages, and D on the channel wall. The cations in site D appear to be the only exchangeable cations at room temperature. During dehydration, cations in site D probably withdraw from the channel walls to a fifth site, site E, which is located between the A sites. The hydrocarbon sorption pores are approximately 7 to 8 Angstroms in diameter.

A more complete description of these zeolites is given, e.g., in U.S. Pat. No. 3,216,789 which, more particularly, gives a conventional description of these zeolites. U.S. Pat. No. 3,216,789 is hereby incorporated by reference to show a type L zeolite useful in the present invention.

Zeolite L differs from other large pore zeolites in a variety of ways, besides X-ray diffraction pattern.

One of the most pronounced differences is in the channel system of zeolite L. Zeolite L has a one-dimensional channel system parallel to the c-axis, while most other zeolites have either two-dimensional or three-dimensional channel systems. Zeolite A, X and Y all have three-dimensional channel systems. Mordenite (Large Port) has a major channel system parallel to the c-axis, and another very restricted channel system parallel to the b-axis. Omega zeolite has a one-dimensional channel system.

Another pronounced difference is in the framework of the various zeolites. Only zeolite L has cancrinite-type cages linked by double-six rings in columns and crosslinked by oxygen bridges to form planar 12-rings. Zeolite A has a cubic array of truncated octa-hedra, beta-cages linked by double-four ring units. Zeolites X and Y both have truncated octahedra, beta-cages, linked tetrahedrally through double-six rings in an arrangement like carbon atoms in a diamond. Mordenite has complex chains of five-rings crosslinked by four-ring chains. Omega has a fourteen-hedron of gmelinite-type linked by oxygen bridges in columns parallel to the c-axis.

Presently, it is not known which of these differences, or other differences, is responsible for the high selectivity for dehydrocyclization of catalysts made from zeolite L, but it is known that catalysts made of zeolite L do react differently than catalysts made of other zeolites.

Various factors have an effect on the X-ray diffraction pattern of a zeolite. Such factors include temperature, pressure, crystal size, impurities, and type of cations present. For instance, as the crystal size of the type L zeolite becomes smaller, the X-ray diffraction pattern becomes broader and less precise. Thus, the term "zeolite L" includes any zeolites made up of cancrinite cages having an X-ray diffraction pattern substantially similar to the X-ray diffraction patterns shown in U.S. Pat. No. 3,216,789.

Crystal size also has an effect on the stability of the catalyst. For reasons not yet fully understood, catalysts having at least 80% of the crystals of the type L zeolite larger than 1000 Angstroms give longer run length than catalysts having substantially all of the crystals of the type L zeolite between 200 and 500 Angstroms. Thus, the larger of these crystallite sizes of type L zeolite is the preferred support.

Type L zeolites are conventionally synthesized largely in the potassium form, i.e., in the theoretical formula given previously, most of the M cations are potassium. The M cations are exchangeable, so that a given type L zeolite, e.g., a type L zeolite in the potassium form, can be used to obtain type L zeolites containing other cations, by subjecting the type L zeolite to ion exchange treatment in an aqueous solution of appropriate salts. However, it is difficult to exchange all of the original cations, e.g., potassium, since some exchangeable cations in the zeolite are in sites which are difficult for the reagents to reach.

Alkaline Earth Metals

A preferred element of the present invention is the presence of an alkaline earth metal in the dehydrocyclization catalyst. That alkaline earth metal must be either barium, strontium or calcium. Preferably the alkaline earth metal is barium. The alkaline earth metal can be incorporated into the zeolite by synthesis, impregnation or ion exchange. Barium is preferred to the other alkaline earths because the resulting catalyst has high activity, high selectivity and high stability.

In one embodiment, at least part of the alkali metal is exchanged with barium, using techniques known for ion exchange of zeolites. This involves contacting the zeolite with a solution containing excess Ba ions. The barium should preferably constitute from 0.1% to 35% of the weight of the zeolite, more preferably from 5% to 15% by weight.

Group VIII Metals

The dehydrocyclization catalysts according to the invention are charged with one or more Group VIII metals, e.g., nickel, ruthenium, rhodium, palladium, iridium or platinum.

The preferred Group VIII metals are iridium, palladium, and particularly platinum, which are more selective with regard to dehydrocyclization and are also more stable under the dehydrocyclization reaction conditions than other Group VIII metals.

The preferred percentage of platinum in the catalyst is between 0.1% and 5%, more preferably from 0.1% to 1.5%.

Group VIII metals are introduced into the zeolite by synthesis, impregnation or exchange in an aqueous solution of an appropriate salt. When it is desired to introduce two Group VIII metals into the zeolite, the operation may be carried out simultaneously or sequentially.

By way of example, platinum can be introduced by impregnating the zeolite with an aqueous solution of tetrammineplatinum (II) nitrate, tetrammineplatinum (II) hydroxide, dinitrodiamino-platinum or tetrammineplatinum (II) chloride. In an ion exchange process, platinum can be introduced by using cationic platinum complexes such as tetrammineplatinum (II) nitrate.

Catalyst Pellets

An inorganic oxide can be used as a carrier to bind the zeolite containing the Group VIII metal and alkaline earth metal and give the dehydrocyclization catalyst additional strength. The carrier can be a natural or a synthetically produced inorganic oxide or combination of inorganic oxides. Preferred loadings of inorganic oxide are from 0% to 40% by weight of the catalyst. Typical inorganic oxide supports which can be used include aluminosilicates (such as clays), alumina, and silica, in which acidic sites are preferably exchanged by cations which do not impart strong acidity.

One preferred inorganic oxide support is alumina. Another preferred support is "Ludox", which is a colloidal suspension of silica in water, stabilized with a small amount of alkali.

When an inorganic oxide is used as a carrier, there are three preferred methods in which the catalyst can be made, although other embodiments could be used.

In the first preferred embodiment, the zeolite is made, then the zeolite is ion exchanged with a barium solution, separated from the barium solution, dried and calcined, impregnated with platinum, calcined, and then mixed with the inorganic oxide and extruded through a die to form cylindrical pellets, then the pellets are calcined. Advantageous methods of separating the zeolite from the barium and platinum solutions are by a batch centrifuge or a pressed filter. This embodiment has the advantage that all the barium and platinum are incorporated on the zeolite and none are incorporated on the inorganic oxide. It has the disadvantage that the large-pore zeolite is of small size, which is hard to separate from the barium solution and the platinum solution.

In the second preferred embodiment, the large-pore zeolite is mixed with the inorganic oxide and extruded through the die to form cylindrical pellets, then these pellets are calcined and then ion exchanged with a barium solution, separated from the barium solution, impregnated with platinum, separated from the platinum solution, and calcined. This embodiment has the advantage that the pellets are easy to separate from the barium and platinum solutions.

In a third possible embodiment, the zeolite is ion exchanged with a barium solution, separated from the barium solution, dried and calcined, mixed with the inorganic oxide and extruded through the die to form cylindrical pellets, then these pellets are calcined and then impregnated with platinum, separated from the platinum solution, and calcined.

In the extrusion of large-pore zeolite, various extrusion aids and pore formers can be added. Examples of suitable extrusion aids are ethylene glycol and stearic acid. Examples of suitable pore formers are wood flour, cellulose and polyethylene fibers.

After the desired Group VIII metal or metals have been introduced, the catalyst is treated in air at about 260° C. and then reduced in hydrogen at temperatures of from 200° C. to 700° C., preferably 200° C. to 620° C.

At this stage the dehydrocyclization catalyst is ready for use in the dehydrocyclization process.

In order to obtain optimum selectivity, temperature should be adjusted so that reaction rate is appreciable, but conversion is less than 98%, as excessive temperature and excess reaction can have an adverse affect on selectivity. Pressure should also be adjusted within a proper range. Too high a pressure will place a thermodynamic (equilibrium) limit on the desired reaction, especially for hexane aromatization, and too low a pressure may result in coking and deactivation and place practical limitations on the use of the hydrogen produced.

The major advantage of this invention is that the process of the present invention gives better catalyst stability than found in prior art processes using zeolitic catalysts. Stability of the catalyst, or resistance to deactivation, determines its useful run length. Longer run lengths result in less down time and expense in regenerating or replacing the catalyst charge.

Run lengths which are too short make the process commercially impractical. With the sulfur control of the prior art, adequate run lengths cannot be obtained. In fact, as shown in the examples below, run lengths of only four to six days were observed at 0.5 ppm to 1 ppm sulfur in the feed. As further shown in the examples below, with adequate sulfur control, a run length in excess of eight months was achieved.

The importance of adequate sulfur control is magnified by the fact that known methods of recovering from sulfur upsets for prior art catalysts are inadequate to remove sulfur from a type L zeolite reforming catalyst, as shown in the examples below.

Various possible sulfur removal systems that can be used to reduce the sulfur concentration of the hydrocarbon feed to below 500 ppb include: (a) passing the hydrocarbon feed over a suitable metal or metal oxide, for example copper, on a suitable support, such as alumina or clay, at low temperatures in the range of 200° F. to 400° F. in the absence of hydrogen; (b) passing a hydrocarbon feed, in the presence or absence of hydrogen, over a suitable metal or metal oxide, or combination thereof, on a suitable support at medium temperatures in the range of 400° F. to 800° F.; (c) passing a hydrocarbon feed over a first reforming catalyst, followed by passing the effluent over a suitable metal or metal oxide on a suitable support at high temperatures in the range of 800° F. to 1000° F.; (d) passing a hydrocarbon feed over a suitable metal or metal oxide and a Group VIII metal on a suitable support at high temperatures in the range of 800° F. to 1000° F.; and (e) any combination of the above.

Sulfur removal from the recycle gas by conventional methods may be used in combination with the above sulfur removal systems.

Sulfur compounds contained in heavier naphthas are more difficult to remove than those in light naphthas. Therefore, heavier naphthas require use of the more effective options listed above.

The average sulfur accumulation (ASA) in ppm on a reforming catalyst may be calculated as follows:

$$ASA = 24 \times (Fs) \times (WHSV) \times \theta$$

where

Fs = feed sulfur in ppm

WHSV = weight of feed per hour per weight of catalyst, $hour^{-1}$

74 = days onstream with sulfur in feed.

Thus, an average sulfur accumulation of 500 ppm would be achieved in 140 days at a weight hourly space velocity of 1.5 $hr.^{-1}$ and a feed sulfur of 100 ppb, while it would take only 28 days to reach the same average sulfur accumulation at a feed sulfur of 500 ppb.

For example, in order to keep the average sulfur accumulation below 500 ppm, the feed sulfur must be kept below x ppb, wherein x is determined as follows:

$$x = \frac{20000}{(WHSV)(\theta)} \; ppb$$

EXAMPLES

The invention will be further illustrated by the following examples which set forth a particularly advantageous method and composition embodiments. While the examples are provided to illustrate the present invention, they are not intended to limit it.

A platinum-barium-type L zeolite was used in each run, which had been prepared by (1) ion exchanging a potassium-type L zeolite having crystal sizes of from about 1000 to 2000 Angstroms with a sufficient volume of 0.3 molar barium nitrate solution to contain an excess of barium compared to the ion exchange capacity of the zeolite; (2) drying the resulting barium-exchanged type L zeolite catalyst; (3) calcining the catalyst at 590° C.; (4) impregnating the catalyst with 0.8% platinum using tetrammineplatinum (II) nitrate; (5) drying the catalyst; (6) calcining the catalyst at 260° C.; and (7) reducing the catalyst in hydrogen at 480° C. to 500° C. for 1 hour, then reducing in hydrogen for 20 hours at 1050° F.

The feed contained 70.2 v% paraffins, 24.6 v% naphthenes, 5.0 v% aromatics, and 29.7 v% C5's, 43.3 v% C6's, 21.2 v% C7's, 5.0 v% C8's, 0.6 v% C9's. Research octane clear of the feed was 71.4. The run conditions were 100 psig, 1.5 LHSV, and 6.0 $H_2$/HC recycle.

Example One

The temperature was controlled to give 50 wt% aromatics in the $C_5$+ liquid product, which corresponds to 89 octane clear. Sulfur control was achieved by (1) hydrofining the feed to less than 50 ppb; (2) passing the feed to the reactor through a supported CuO sorber at 300° F.; and (3) passing the recycle gas through a supported CuO sorber at room temperature. The results are shown below;

| Run Time, Hrs. | For 50 wt % Aromatics In Liquid, Temperature °F. | $C_5$+ Yield LV % |
|---|---|---|
| 500 | 858 | 86.4 |
| 1000 | 868 | 86.2 |
| 2000 | 876 | 86.1 |
| 2500 | 880 | 86.2 |
| 3000 | 881 | 86.2 |
| 4000 | 885 | 86.2 |
| 5000 | 889 | 86.2 |

-continued

| Run Time, Hrs. | For 50 wt % Aromatics In Liquid, Temperature °F. | $C_5$+ Yield LV % |
|---|---|---|
| 5930 | 892 | 86.2 |

Example Two

The second example was run as shown in Example 1 except that (1) the catalyst at startup was reduced with hydrogen at 900° F. for 16 hours instead of 1050° F. for 20 hours; (2) there was no sulfur sorber; and (3) 1 ppm sulfur was added to the feed after 480 hours. The results before and after sulfur addition are shown in the following table. After 600 hours, control of temperature to maintain the required aromatics content was no longer possible due to rapid catalyst deactivation. After 670 hours, the addition of sulfur to the feed was discontinued, and clean feed was used. No recovery of activity was observed during 50 hours of clean feed operation. In addition, the feed was withdrawn at 720 hours, and the catalyst was stripped with sulfur-free hydrogen gas for 72 hours at 930° F. Only a small gain in activity was observed. At the end of the run, the catalyst contained 400 ppm Sulfur.

| Run Time, Hrs. | For 50 wt % Aromatics In Liquid, Temperature °F. | $C_5$+ Yield LV % |
|---|---|---|
| 200 | 862 | 84.5 |
| 400 | 866 | 85.4 |
| 480 | 868 | 84.8 |
| 550 | 882 | 86.1 |
| 600 | 908 | 86.2 |

Example Three

The third example was run as shown in Example 2 except that 0.5 ppm sulfur was added to the feed from 270 hours to 360 hours on stream, and again from 455 hours to 505 hours on stream. After 450 hours, control of temperature to maintain the required aromatics content was no longer possible due to rapid catalyst deactivation. At the end of the run, the catalyst contained 200 ppm Sulfur. The results are shown below:

| Run Time, Hrs. | For 50 wt % Aromatics In Liquid, Temperature °F. | $C_5$+ Yield LV % |
|---|---|---|
| 200 | 862 | 84.2 |
| 300 | 864 | 85.0 |
| 350 | 876 | 85.6 |
| 400 | 887 | 85.6 |
| 450 | 896 | 85.5 |
| 500 | 904 | 85.8 |

While the present invention has been described with reference to specific embodiments, this application is intended to cover those various changes and substitutions which may be made by those skilled in the art without departing from the spirit and scope of the appended claims.

What is claimed is:

1. A hydrocarbon conversion process comprising reforming a hydrocarbon feed having a sulfur concentration of below 100 ppb over a catalyst comprising a large-pore zeolite containing at least one Group VIII metal to produce aromatics and hydrogen.

2. A hydrocarbon conversion process according to claim 1 wherein said large-pore zeolite is a type L zeolite.

3. A hydrocarbon conversion process comprising:
(a) subjecting a hydrocarbon feed to hydrotreating;
(b) passing said hydrotreated hydrocarbon feed through a sulfur removal system to reduce the sulfur concentration of said hydrotreated hydrocarbon feed to below 100 ppb; and
(c) reforming said hydrotreated hydrocarbon feed having a sulfur concentration of below 100 ppb over a dehydrocyclization catalyst comprising a type L zeolite containing at least one Group VIII metal to produce aromatics and hydrogen.

4. A hydrocarbon conversion process according to claim 3 wherein said sulfur concentration in steps (b) and (c) is below 50 ppb.

5. A hydrocarbon conversion process according to claim 3 wherein said dehydrocyclization catalyst contains an alkaline earth metal selected from the group consisting of barium, strontium, and calcium.

6. A hydrocarbon conversion process according to claim 5 wherein said alkaline earth metal is barium and wherein said Group VIII metal is platinum.

7. A hydrocarbon conversion process according to claim 6 wherein said dehydrocyclization catalyst has from 0.1% to 35% by weight barium and from 0.1% to 5% by weight platinum.

8. A hydrocarbon conversion process according to claim 7 wherein said dehydrocyclization catalyst has from 5% to 15% by weight barium and from 0.1% to 1.5% by weight platinum.

9. A hydrocarbon conversion process according to claim 3 wherein the majority of the crystals of said type L zeolite are larger than 500 Angstroms.

10. A hydrocarbon conversion process according to claim 9 wherein the majority of the crystals of said type L zeolite are larger than 1000 Angstroms.

11. A hydrocarbon conversion process according to claim 10 wherein at least 80% of the crystals of said type L zeolite are larger than 1000 Angstroms.

12. A hydrocarbon conversion process according to claim 1 wherein said dehydrocyclization catalyst comprises:
(a) a large-pore zeolite containing platinum; and
(b) an inorganic binder.

13. A hydrocarbon conversion process according to claim 12 wherein said inorganic binder is selected from the group consisting of silica, alumina, and aluminosilicates.

14. A hydrocarbon conversion process comprising reforming a hydrocarbon feed over a catalyst comprising a type L zeolite containing at least one Group VIII metal to produce aromatics and hydrogen, wherein said hydrocarbon feed has a sulfur concentration of below x ppb, wherein x is determined from the formula $$x = \frac{20000}{(WHSV)(\theta)} \; ppb$$

where
WHSV is the weight of feed per hour per weight of catalyst, $hour^{-1}$, and
$\theta$ is the desired run length in days.

* * * * *

UNITED STATES PATENT AND TRADEMARK OFFICE

CERTIFICATE OF CORRECTION

PATENT NO. : 4,456,527
DATED : June 26, 1984
INVENTOR(S) : WALDEEN C. BUSS, ET AL.

It is certified that error appears in the above-identified patent and that said Letters Patent are hereby corrected as shown below:

Col. 2, line 52, "thermodynamically kinetically" should read --thermodynamically and kinetically --.

Col. 7, line 10, "peridod" should read --period--

Col. 13, line 10, "74" should read --θ--

Signed and Sealed this

*Twenty-sixth* Day of *March 1985*

[SEAL]

*Attest:*

DONALD J. QUIGG

*Attesting Officer* *Acting Commissioner of Patents and Trademarks*

REEXAMINATION CERTIFICATE (510th)

United States Patent [19]

Buss et al.

[11] B1 4,456,527

[45] Certificate Issued May 20, 1986

[54] HYDROCARBON CONVERSION PROCESS

[75] Inventors: Waldeen C. Buss, Kensington; Leslie A. Field, Oakland; Richard C. Robinson, San Rafael, all of Calif.

[73] Assignee: Chevron Research Company, San Francisco, Calif.

Reexamination Request:
No. 90/000,762, Apr. 19, 1985

Reexamination Certificate for:

| | |
|---|---|
| Patent No.: | **4,456,527** |
| Issued: | **Jun. 26, 1984** |
| Appl. No.: | **477,111** |
| Filed: | **Mar. 21, 1983** |

Certificate of Correction issued Mar. 26, 1985.

Related U.S. Application Data

[63] Continuation-in-part of Ser. No. 436,498, Oct. 20, 1982, abandoned.

[51] Int. Cl.[4] ..... C10G 45/00
[52] U.S. Cl. ..... 208/89; 208/138
[58] Field of Search ..... 208/89, 138

[56] References Cited

U.S. PATENT DOCUMENTS

| | | | |
|---|---|---|---|
| 3,216,789 | 11/1965 | Breck et al. | 423/329 |
| 3,397,137 | 8/1968 | Pickert et al. | 208/138 |
| 3,415,737 | 12/1968 | Kluksdahl | 208/139 |
| 3,507,781 | 4/1970 | Spurlock et al. | 208/138 |
| 3,554,902 | 1/1971 | Buss | 208/138 |
| 3,650,944 | 3/1972 | McCoy et al. | 208/65 |
| 3,718,578 | 2/1973 | Buss et al. | 208/139 |
| 3,867,512 | 2/1975 | Young | 423/329 |
| 3,898,153 | 8/1975 | Louder et al. | 208/89 |
| 4,104,320 | 8/1978 | Bernard et al. | 208/138 |
| 4,163,708 | 8/1979 | Jacobson et al. | 208/89 |
| 4,225,417 | 9/1980 | Nelson | 208/89 |
| 4,416,806 | 7/1981 | Bernard et al. | 502/74 |

FOREIGN PATENT DOCUMENTS

| | | |
|---|---|---|
| 1202511 | 8/1970 | United Kingdom . |
| 1319265 | 6/1973 | United Kingdom . |
| 1393365 | 5/1975 | United Kingdom . |
| 1423889 | 2/1976 | United Kingdom . |

OTHER PUBLICATIONS

Hayes et al, Div. of Petroleum Chemistry, American Chemical Society, 19 (2), 334–345 (1974).
Pfefferle, Div. of Petroleum Chemistry, American Chemical Society 15 (1), A21–A23 (1970).
Freiburger et al, "Recent Catalyst and Process Improvements in Commercial Rheniforming" Presented at 1980 NPRA Meeting.
Besaukhanova et al., "The Sulfur Poisoning at PT Alkaline L Zeolites", *Catalyst Deactivation*, 1980, Elsevier Scientific Pub Co. Amsterdam, pp. 201–211.
Buss et al, "New Developments in Rheniforming" Presented at 1978 NPRA Meeting.

*Primary Examiner*—Curtis R. Davis

[57] ABSTRACT

A hydrocarbon conversion process is disclosed having a very high selectivity for dehydrocyclization. In one aspect of this process, a hydrocarbon feed is subjected to hydrotreating, then the hydrocarbon feed is passed through a sulfur removal system which reduces the sulfur concentration of the hydrocarbon feed to below 500 ppb, and then the hydrocarbon feed is reformed over a dehydrocyclization catalyst comprising a large pore zeolite containing at least one group VIII metal to produce aromatics and hydrogen.

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 1-13 is confirmed.

Claim 14 is cancelled.

* * * * *